US006853335B1

(12) United States Patent
Yeh

(10) Patent No.: US 6,853,335 B1
(45) Date of Patent: Feb. 8, 2005

(54) MINIATURE MONOPOLE ANTENNA FOR DUAL-FREQUENCY PRINTED CIRCUIT BOARD

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 8 days.

(21) Appl. No.: 10/644,825

(22) Filed: Aug. 21, 2003

(51) Int. Cl.[7] ..... H01Q 1/38

(52) U.S. Cl. ..... 343/700 MS; 343/702; 343/829

(58) Field of Search ..... 343/700 MS, 702, 343/825, 829, 847

(56) References Cited

U.S. PATENT DOCUMENTS 6,747,600 B2 * 6/2004 Wong et al. ..... 343/700 MS 6,801,169 B1 * 10/2004 Chang et al. ..... 343/700 MS

* cited by examiner

*Primary Examiner*—Shih-Chao Chen
(74) *Attorney, Agent, or Firm*—Bacon & Thomas PLLC

(57) ABSTRACT

The present invention discloses a miniature monopole antenna for dual-frequency printed circuit board, which individually prints a printed wire, two radiators, and a metal grounding surface on a dielectric printed wire board to form a monopole antenna. Therefore, the antenna can be operated within the dual-frequency range as specified by the IEEE 802.11*a* protocol and the IEEE 802.11*b* protocol. The monopole antenna designed in this invention not only can receive dual-frequency signals, but also can reduce the occupying volume to about one half of that of the traditional inverted L-shaped monopole antenna, which can effectively reduce the volume of the wireless communication products and comply with the trend of the compact design.

6 Claims, 6 Drawing Sheets

MINIATURE MONOPOLE ANTENNA FOR DUAL-FREQUENCY PRINTED CIRCUIT BOARD

BACKGROUND OF THE INVENTION

1. Field of the Invention

The present invention relates to an antenna, more particularly to a miniature monopole antenna for dual-frequency printed circuit boards.

2. Description of the Related Art

In general, a so-called Lecher wire is usually used in the traditional parallel antenna structure of televisions. Please refer to FIG. 1. When the parallel radiation metal pipe 14 (such as a copper pipe) of such antenna is nearby, it can sense that the current flows in an opposite direction (as indicated by the arrow in FIG. 1), and thus causing an electromagnetic field in opposite directions to offset with each other without producing a radiation. Therefore, in order to let an antenna maintain an effective radiation of electric waves in a narrow space, the front end of a Lecher wire is generally divided into two ends and bent 90 degrees in opposite directions with each other as shown in FIG. 2, such that the current can flow in the same direction (as indicated by the arrow in FIG. 2) to constitute a so-called dipole antenna. Such dipole antenna uses a transmission line of the balanced structure as a feed line 24, and two signal line terminals 242 of the transmission line of such balanced structure is extended separately to the same length in opposite directions. The length of such signal line terminal is about a quarter of the resonance wavelength (λ), and thus the total length is about half of the resonance wavelength (λ). The dipole antenna can thus use two sections of such signal line terminal with a length equal to a quarter of the wavelength as the radiator. Therefore, such antenna is also called half-wavelength dipole antenna, which is generally adopted in a mono-frequency design.

To make the antenna lighter, thinner, shorter, and smaller, some manufacturers build the antenna in a printed circuit board. Please refer to FIGS. 3 and 4 for the printed antenna, which comprises a dielectric printed wire board; a printed wire 34 built on one side of the printed wire board 37, and one end of the printed wire 34 is used as a signal feed terminal 341, and the other end of the dielectric printed wire board 37 comprises a metal grounding surface 38 corresponding to the position of the printed wire 34, and the other end of the printed wire 34 extends an inverted L-shaped radiator 342 from a position other than that corresponding to the metal grounding surface 38 to define a monopole antenna. Such monopole antenna bases on the image theory to map images of the unbalanced structure of the printed wire 34 and the inverted L-shaped radiator 342 on the metal grounding surface 38, and thus forming a radiator structure equivalent to the aforementioned dipole antenna, and such monopole antenna is generally adopted in a mono-frequency design.

In recent years, since the demand of mobile communication products in the market has been increasing drastically, it expedites the development of wireless communications. Among so many wireless communication standards, the most eye-catching one is the IEEE 802.11 wireless local area network protocol established in 1997, such protocol not only provides unprecedented functions for wireless communications, but also offers a solution for mutual communications between different branded wireless products. Therefore, such protocol opens up a new mileage to the development of wireless communication. However, the IEEE tried to combine the IEEE/ANSI and the ISO/IEC into a joint standard in August of 2000 and further revised the specification. The contents of such revision include two important protocols: the IEEE 802.11a protocol and the IEEE 802.11b protocol. According to the rules of these two protocols, the bandwidths of an extended standard physical layer must be set to 5 GHz and 2.4 GHz respectively. Therefore, when a wireless communication product wants to use both wireless communication protocols, the aforementioned traditional antenna no longer can satisfy such requirement, but has to install additional antennas according to the bandwidth requirements. However, such arrangement not only increases the component cost, complicates the installation procedure, but also requires more space for installing such antennas on the wireless communication product. As a result, the volume of the wireless communication product cannot be reduced to comply with the trend of a compact design.

SUMMARY OF THE INVENTION

In view of the shortcomings that the aforementioned traditional mono-frequency antenna no longer can satisfy the requirements of multiple bandwidths, the inventor of the present invention based on years of experience and professional knowledge accumulated in the engagement of the antenna manufacturing industry and focused on the features of monopole antennas to find a feasible solution. After performing a series of researches and experiments, the inventor made an improvement and invented a monopole antenna in accordance to the present invention that can be used on the dual-frequency printed circuit boards. The compact design and structure of the monopole antenna of the present invention can receive the dual-frequency signals as specified by the IEEE 802.11a and IEEE 802.11b protocols.

The primary objective of the present invention is to provide an antenna structure by printing a printed wire on one side of a dielectric printed wire board, using such end as a signal feed terminal, and coating a metal grounding surface on the other end of the dielectric printed wire board at a position corresponding to the printed wire. One end of the printed wire is extended from a position other than that of the corresponding metal grounding surface; after the printed wire is extended to a predetermined length, it is bent to about 90 degrees towards one side, and a radiator with a predetermined length is extended, and then bent to about 90 degrees in the direction away from the metal grounding surface. After a predetermined length is extended, it is bent to about 90 degrees in the direction parallel to the radiator, and then extended to a position corresponding to another end of the printed wire to form another radiator. The lengths of such two radiators are substantially equal, in which the printed wire at a position other than the metal grounding surface extends from the radiator to a length on a free end of another radiator, which is approximately equal to a quarter of the wavelength of the dual mid/low frequency resonance waves. Such radiator can serve as high-frequency or low-frequency radiators to produce signals of different bandwidths.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
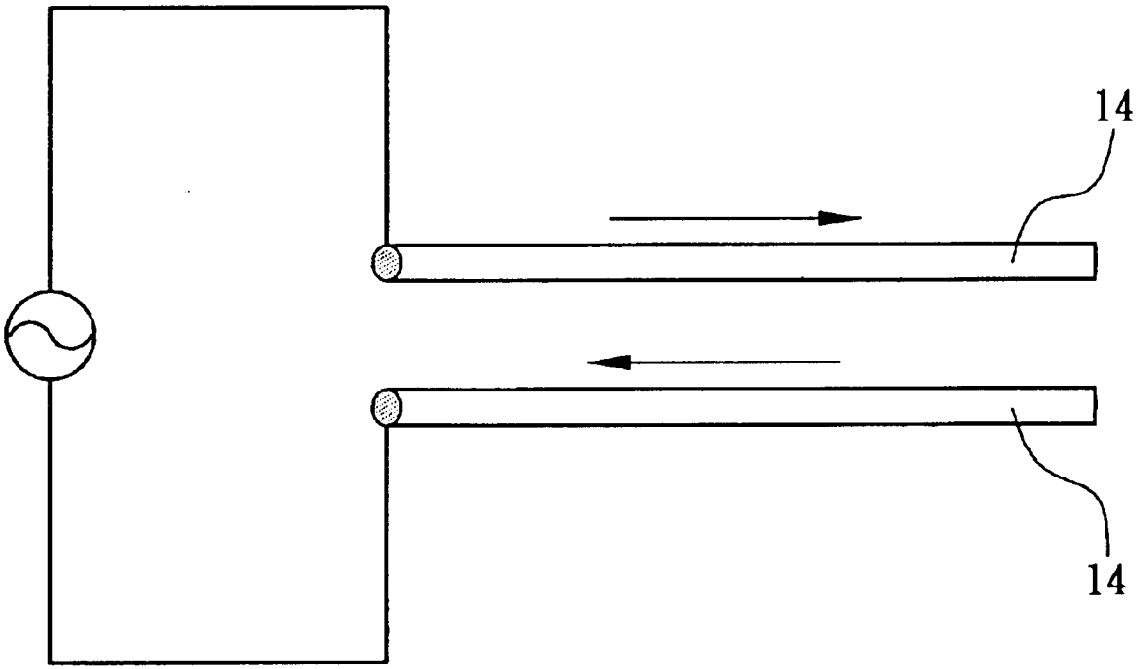
FIG. 1 (Prior Art)
FIG. 1 is an illustrative diagram of a traditional wireless communication device.
Figure 2:
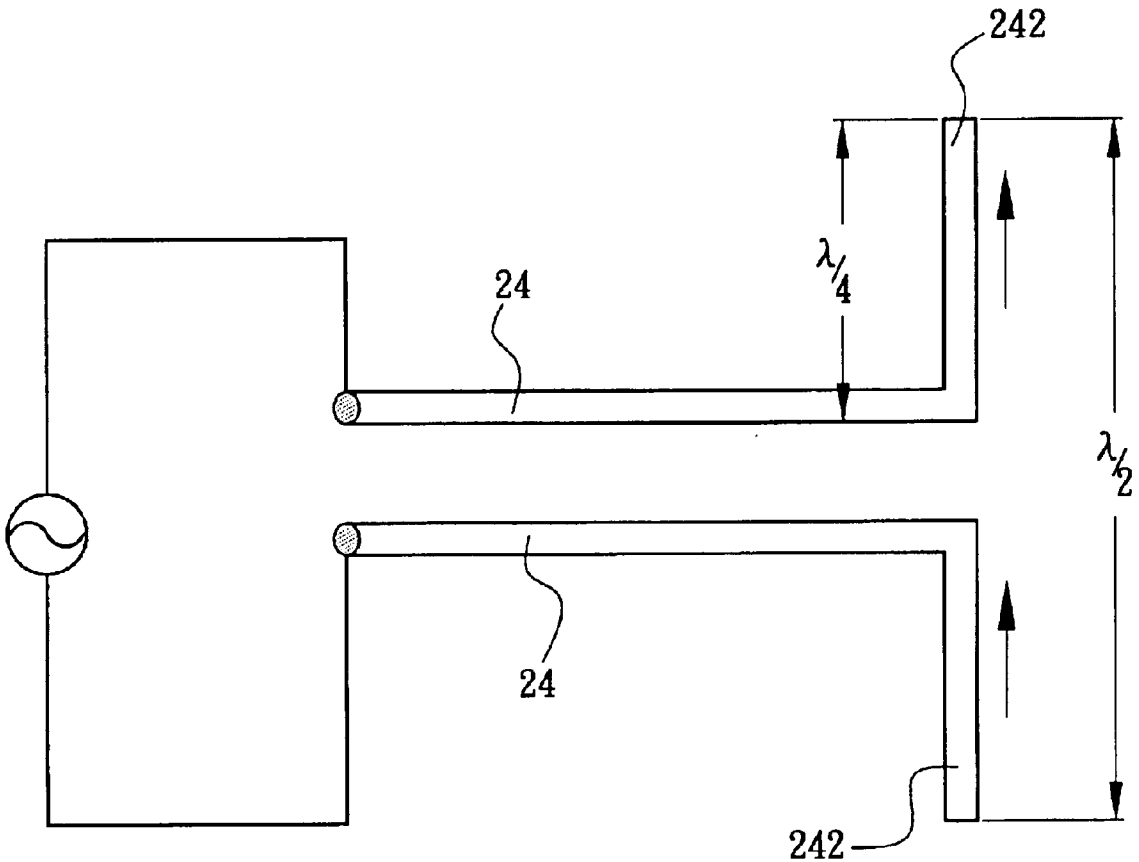
FIG. 2 (Prior Art)
FIG. 2 is an illustrative diagram of a traditional coaxial cable sleeve cable.
Figure 3:
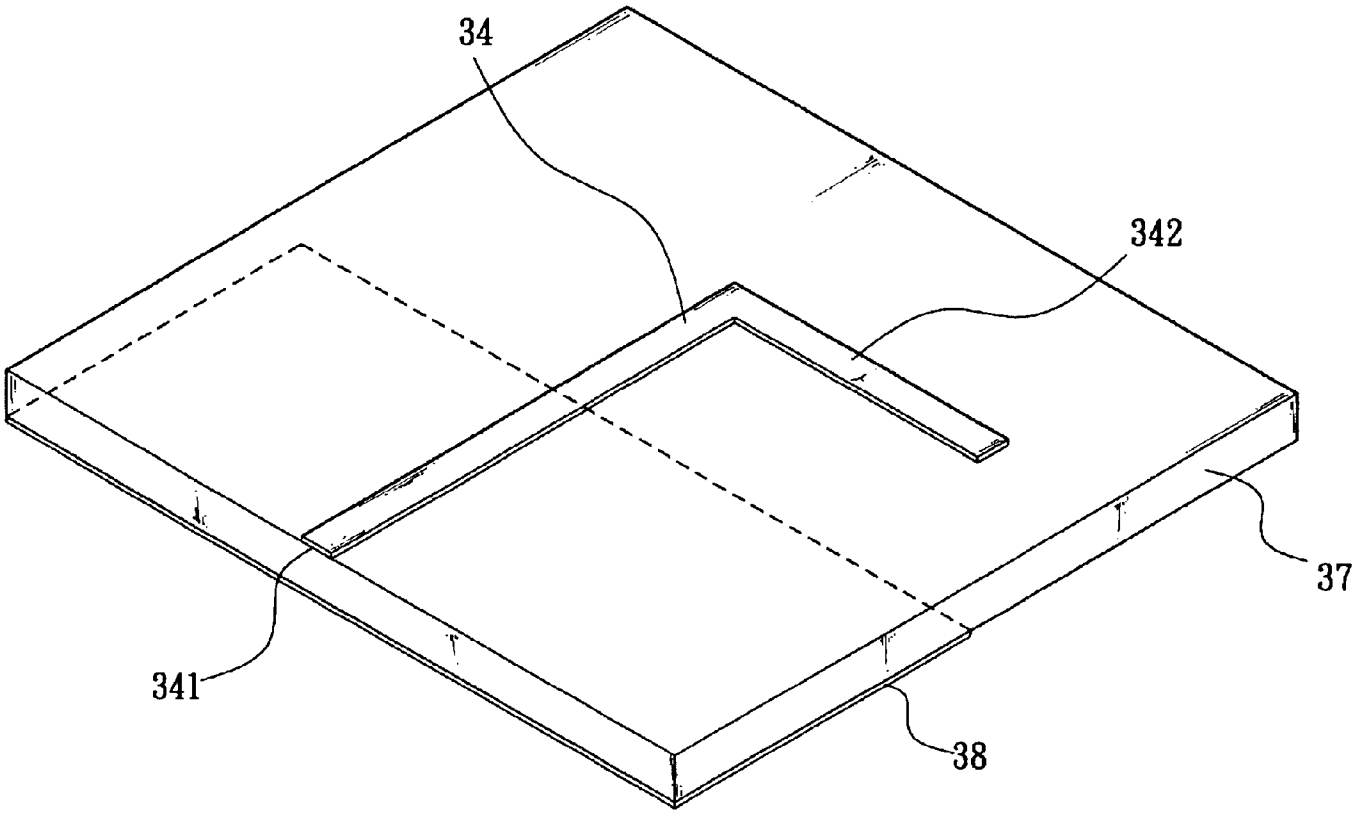
FIG. 3 (Prior Art)
FIG. 3 is an illustrative diagram of a traditional printed antenna.
Figure 4:
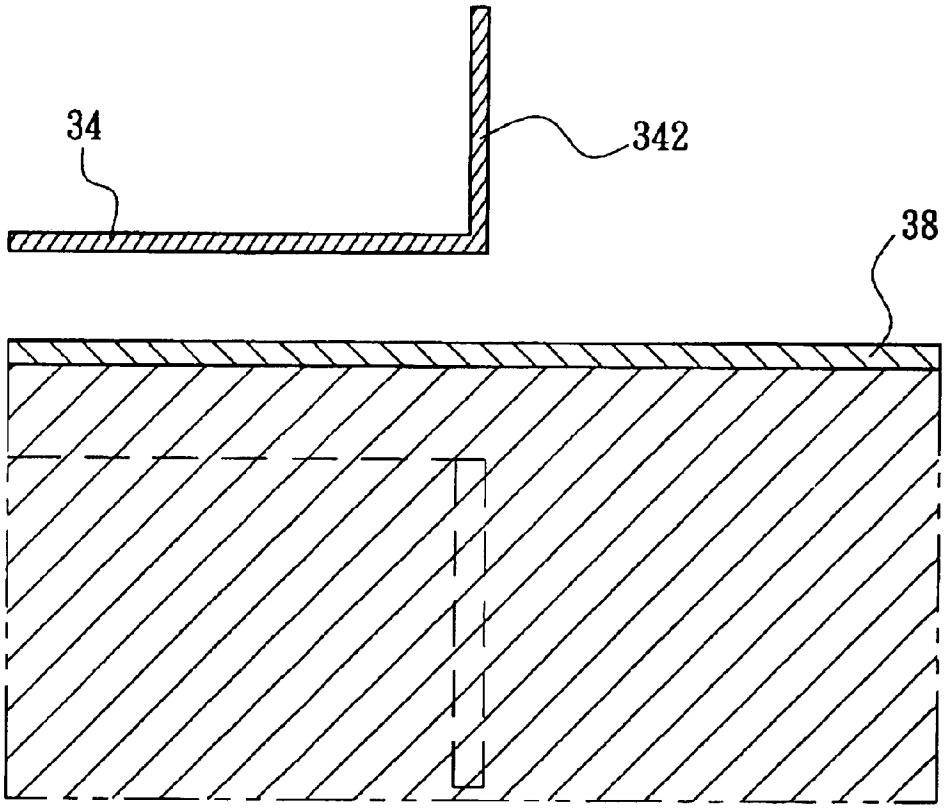
FIG. 4 (Prior Art)
FIG. 4 is an illustrative diagram of a traditional dipole antenna.
Figure 5:
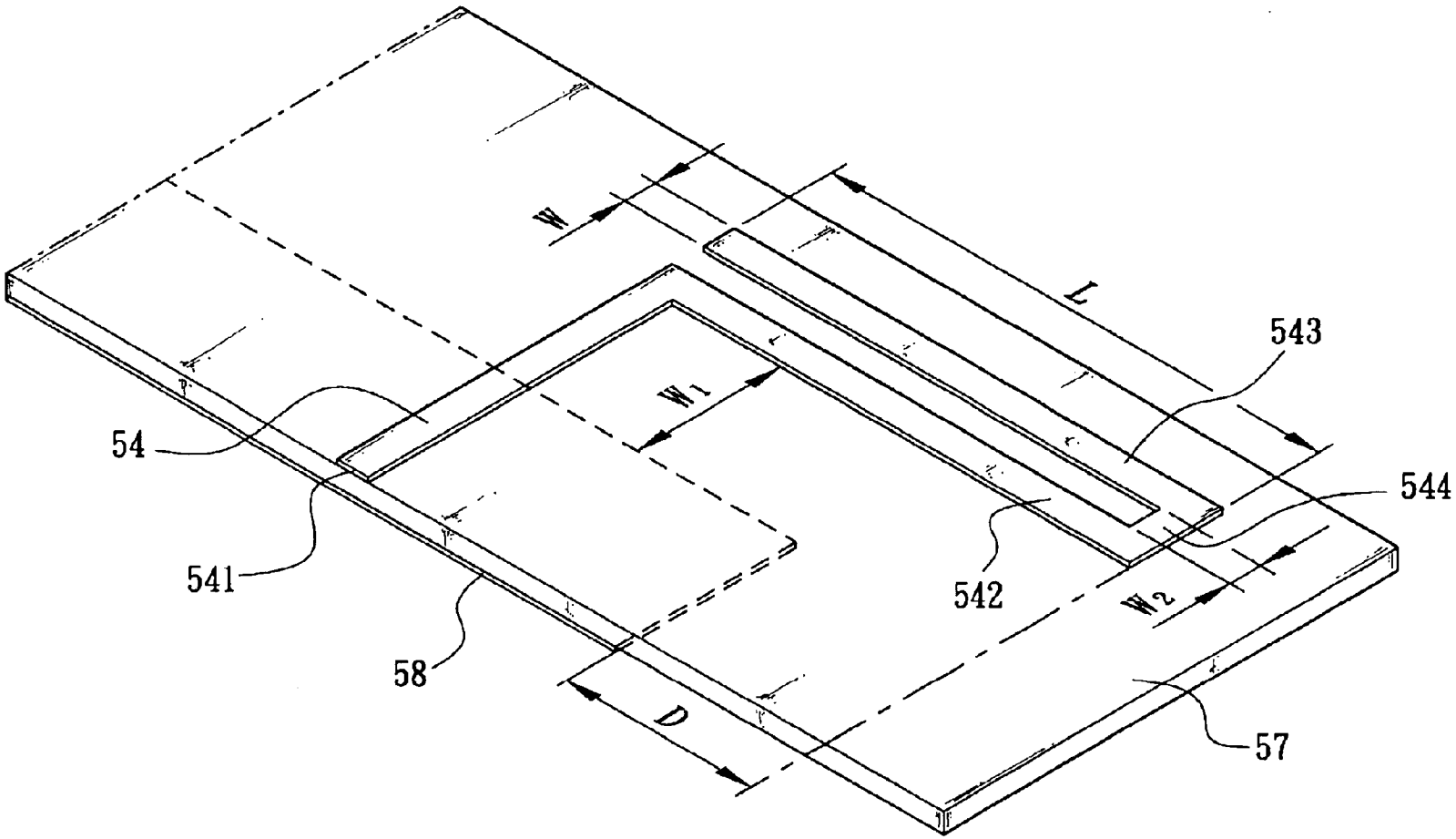
FIG. 5 is an illustrative diagram of a preferred embodiment of the present invention.

Please refer to FIG. 5 for a preferred embodiment of the present invention, which comprises a printed wire 54 of constant resistance of 50 ohms printed on one side of a dielectric printed wire board 57, and such end is used as the signal feed terminal 541, and the other end of the dielectric printed wire board 57 has a metal grounding surface 58 coated on the position corresponding to the printed wire 54. One end of the printed wire 54 is extended from a position other than that of the corresponding metal grounding surface 58, after the printed wire 54 is extended to a predetermined length $W_1$, it is bent to about 90 degrees towards one side, and a radiator 542 with a predetermined length L is extended, and then bent to about 90 degrees in the direction away from the metal grounding surface 58. After a predetermined length $W_2$ is extended, it is bent to about 90 degrees in the direction parallel to the radiator 542, and then extended to a position corresponding to another end of the printed wire 54 to form another radiator 543. The lengths of such two radiators 542, 543 are substantially parallel, equal in length, and respectively connected to each other at one end. In addition, the printed wire 54 at a position other than the metal grounding surface 58 extends from the radiator 542 to a length on a free end of another radiator 543, which is approximately equal to a quarter of the wavelength of the dual mid/low frequency resonance waves. Such radiator 542, 543 can serve as high-frequency or low-frequency radiators to receive the dual-frequency signals as specified by the IEEE 802.11 a and the IEEE 802.11b protocols.

Please refer to FIG. 5 for the foregoing preferred embodiment of the present invention again. Please notice that the experiment and test shows the shape and structure of the monopole antenna in accordance with the present invention and its relation with the metal grounding surface 58. The following requirements must be satisfied to have a better effect on receiving the dual-frequency signals as specified in the IEEE 802.11a and the IEEE 802.11b protocols:

(1) The two radiators 542, 543 are parallel to each other, substantially equal in length, and connected with each other at one end; and the distance apart is $W_2$ which should be kept not larger than 1.5 times of the width W of the printed wire 54 and not less than 0.5 times of the width W of the printed wire 54. In other words, $1.5 \geqq W_2 \geqq 0.5W$.

(2) The edge of the metal grounding surface 58 should keep an appropriate distance D from the external edge of the bent position 544 where the two radiators 542, 543 are connected and along the horizontal direction of the two radiators 542, 543. Such distance D falls within the range of 40%–60% of the length L of each radiator 542, 543, and particularly such distance D is preferably equal to one half of the length of each radiator 542, 543. In other words, D≈50% of L. If the distance D is too long or too short, it will affect the high frequency or low frequency sections.

(3) The distance $W_1$ between the external edge of the radiator 542 adjacent to the metal grounding surface 58 and the corresponding edge of the metal grounding surface 58 should be kept in an appropriate range of not larger than 5.5 times of the width W of the printed wire 54 and not smaller than 2 times of the width W of the printed wire 54. In other words, $5.5W_2 \geqq W_1 \geqq 2W$. Such arrangement can match with the optimal low-frequency resonance point.

(4) Since the two radiators 542, 543 are used to receive signals of different frequencies, therefore the length extended from the printed wire 54 at a position other than the corresponding metal grounding surface 58 to the free end of each radiator 542, 543 should be in a specific proportion between the desired different resonance frequencies for the antenna. In the preferred embodiments of the present invention, the length extended from the printed wire 54 at a position other than the metal grounding surface 58 through the radiator 542 to the free end of another radiator 543, which is approximately equal to a quarter of the length of the desired dual-frequency low/high resonance waves, so that each radiator 542, 543 can be used to receive the dual-frequency signals as specified by the IEEE 802.11a protocol and the IEEE 802.11b protocol.

Figure 6:
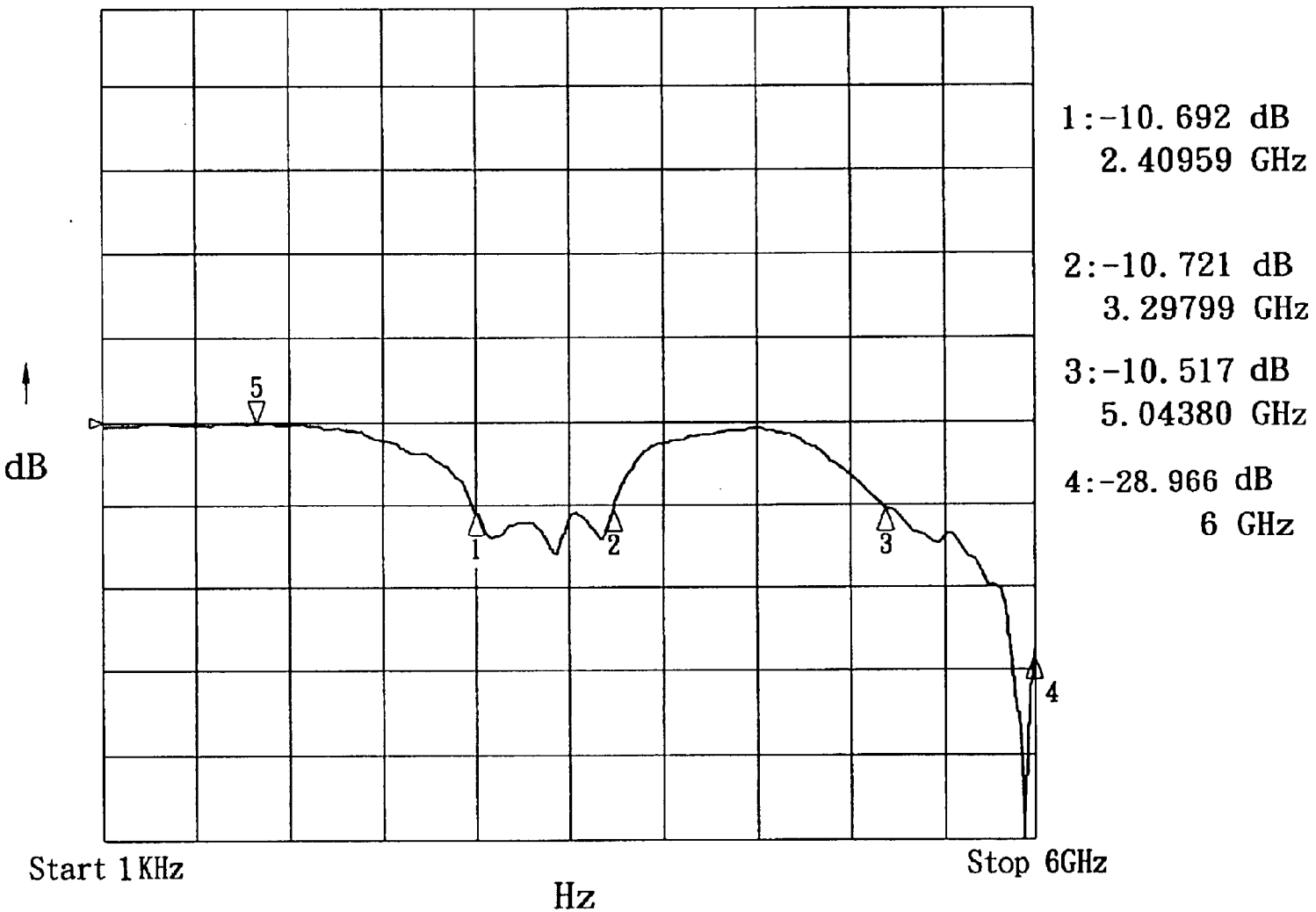
FIG. 6 is a graph of the actual measured result of the return loss according to the dipole antenna of FIG. 5.

In the practical application of the present invention, the antenna structure as shown in FIG. 5 individually prints the printed wire 54, the two radiators 542, 543, and the metal grounding surface 58 to about 0.8 nm thick on a sheet dielectric printed wire board 57 with a dielectric coefficient of about 4.3–4.6 to form the monopole antenna in accordance with the present invention; wherein the widths of the printed wire 54 and the two radiators 542, 543 equal to 1 mm, the length L of the two radiators 542, 543 equals to 13 mm, the distance $W_2$ between the two radiators 542, 543 equals to 1 mm; the distance D between the edge of the metal grounding surface 58 and the external edge of the bent position where two radiators 542, 543 are connected equals to 6 mm, and the distance $W_1$ between the external edge of the radiator 542 adjacent to the metal grounding surface 58 and the corresponding edge of the metal grounding surface 58 equals to 3.5 mm. Therefore, the antenna is operated within the dual-frequency range as specified by the IEEE 802.11a protocol and the IEEE 802.11b protocol, and the actual measured testing result of the return loss is shown in FIG. 6. The two frequencies are better than 10~11 dB. Therefore, the measured test result shows that the monopole antenna designed in this invention not only can receive dual-frequency signals, but also can reduce the occupying volume to about one half of that of the traditional inverted L-shaped monopole antenna by means of the design of the bent position 544 between the two radiators 542, 543. Therefore, the miniature design of the monopole antenna according to the present invention can effectively reduce the volume of the wireless communication products and comply with the trend of the compact design.

While the invention has been described by means of specific embodiments, numerous modifications and variations could be made thereto by those skilled in the art without departing from the scope and spirit of the invention set forth in the claims.

What is claimed is:

1. A miniature monopole antenna for dual-frequency printed circuit board, comprising:

a dielectric printed wire board;

a printed wire, being printed on one side of said dielectric printed wire board and one of its ends serving as a signal feed terminal;

a metal grounding surface, being printed on another side of said dielectric printed wire board at a position corresponding to said printed wire;

two radiators, of which one being extended from one end of said printed wire at a position other than the corresponding metal grounding surface, and being bent into approximately 90 degrees after being extended to a predetermined length in the direction away from the metal grounding surface to form a radiator of the predetermined length, and then extended along the direction parallel to said radiator and bent into approximately 90 degrees and being extended to another predetermined length along the direction parallel to said radiator and bent to approximately 90 degrees and then being extended to a corresponding position on another end of said printed wire to define another radiator.

2. The miniature monopole antenna for dual-frequency printed circuit board of claim 1, wherein said two radiators are substantially equal in length.

3. The miniature monopole antenna for dual-frequency printed circuit board of claim 1, wherein said two radiators are parallel to each other, and maintain a predetermined distance apart, and said distance is not larger than 1.5 times of the width of the printed wire and not less than 0.5 times of the width of the printed wire.

4. The miniature monopole antenna for dual-frequency printed circuit board of claim 1, wherein said metal grounding surface keeps its edge along the direction horizontal to said radiators and an appropriate distance between the bending position where said two radiators being connected, and said distance falls in the range of 40%–60% of the length of said each radiator.

5. The miniature monopole antenna for dual-frequency printed circuit board of claim 1, wherein said radiator proximate said metal grounding surface keeps its external edge at a predetermined distance from the corresponding edge of said metal grounding surface, and the range of said distance is not larger than 5.5 times of the width W of said printed wire and not less than 2 times of the width W of said printed wire.

6. The miniature monopole antenna for dual-frequency printed circuit board of claims 1, wherein said monopole antenna has a length extending from the printed wire at a position other than the metal grounding surface to the free end of another radiator through the radiator approximately equal to one quarter of the desired dual-frequency high/low resonance wavelength.

* * * * *